US006644339B2

(12) United States Patent
Gorges et al.

(10) Patent No.: US 6,644,339 B2
(45) Date of Patent: Nov. 11, 2003

(54) HORIZONTAL-FLOW TRAP AND HOUSING ASSEMBLY WITH ODOR PREVENTING CLOSURE MECHANISM

(75) Inventors: Ditmar L. Gorges, Brentwood, CA (US); Michael Higgins, La Habra Heights, CA (US)

(73) Assignee: Falcon Waterless Technologies, Los Angeles, CA (US)

( * ) Notice: Subject to any disclaimer, the term of this patent is extended or adjusted under 35 U.S.C. 154(b) by 68 days.

(21) Appl. No.: 10/055,833

(22) Filed: Jan. 22, 2002

(65) Prior Publication Data

US 2002/0069913 A1 Jun. 13, 2002

Related U.S. Application Data

(63) Continuation-in-part of application No. 09/515,870, filed on Feb. 29, 2000, now abandoned

(60) Provisional application No. 60/263,321, filed on Jan. 22, 2001.

(51) Int. Cl.[7] ..... F16L 29/00; A47K 11/00

(52) U.S. Cl. ..... 137/315.41; 251/149.8; 4/144.1

(58) Field of Search ..... 137/315.41; 251/149.5, 251/149.8; 4/144.1, 310, 311, 679

(56) References Cited

U.S. PATENT DOCUMENTS

| | | | | |
|---|---|---|---|---|
| 1,050,290 A | * | 1/1913 | Posson et al. | 4/DIG. 11 |
| 5,711,037 A | * | 1/1998 | Reichardt et al. | 4/144.1 |
| 6,053,197 A | * | 4/2000 | Gorges | 137/247.39 |
| 6,425,411 B1 | * | 7/2002 | Gorges | 137/247.39 |

* cited by examiner

*Primary Examiner*—John Rivell
(74) *Attorney, Agent, or Firm*—Lewis B. Sternfels

(57) ABSTRACT

An odor trap apparatus (20) includes a housing (32) having an interior and an opening (48) extending from the interior to the external drain, and a cartridge (22). The cartridge has an exit opening (78) disposed to communicate with the housing opening. The cartridge and the housing have positions of final secured interconnection, when openings (26, 48) are aligned, and of initial unsecured interconnection, when their openings are not aligned. A lever (52) is swivelably secured to the housing bottom wall (46), and has a cap (54) for closing the housing exit tube (28) and a projection (56) engageable with the cartridge for effecting the closure when the housing opening (48) is not aligned with the cartridge exit opening (78). Three L-shaped keyways (60) in the housing interior are adapted to mate with three keyways (82) in the cartridge, and have corrugated surfaces to provide a ratcheted secure connection between the cartridge and the housing when in the secure orientation. A tool (92) is used to insert and to remove the cartridge from the housing.

24 Claims, 11 Drawing Sheets

FIG. 16
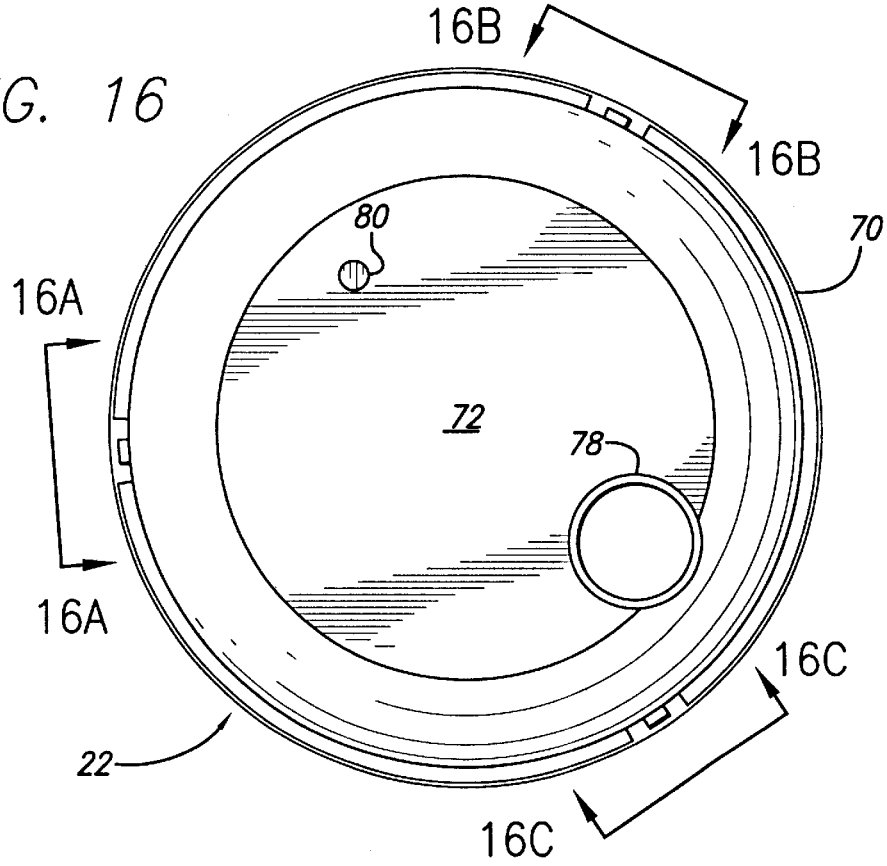
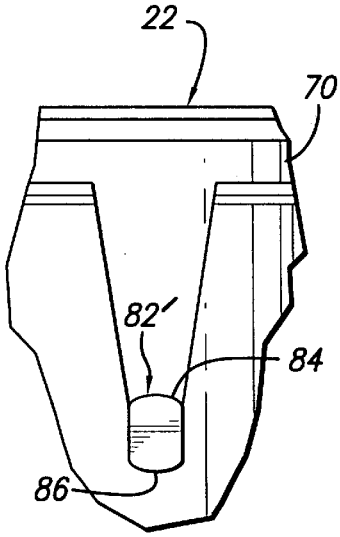
FIG. 16A
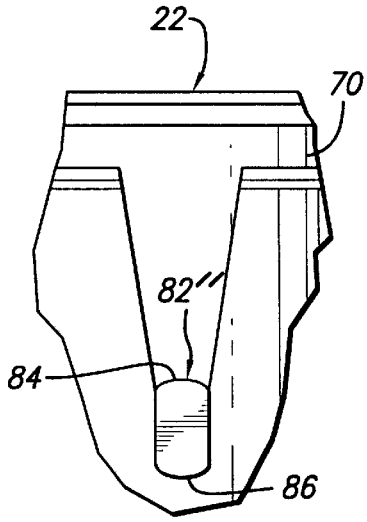
FIG. 16B
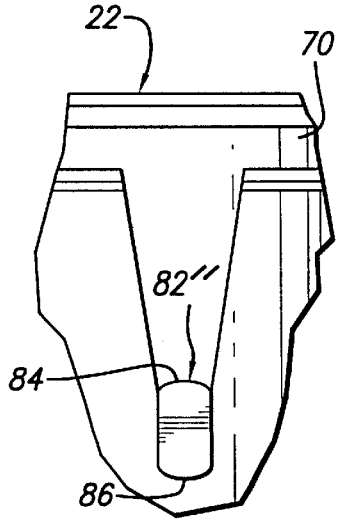
FIG. 16C

FIG. 17
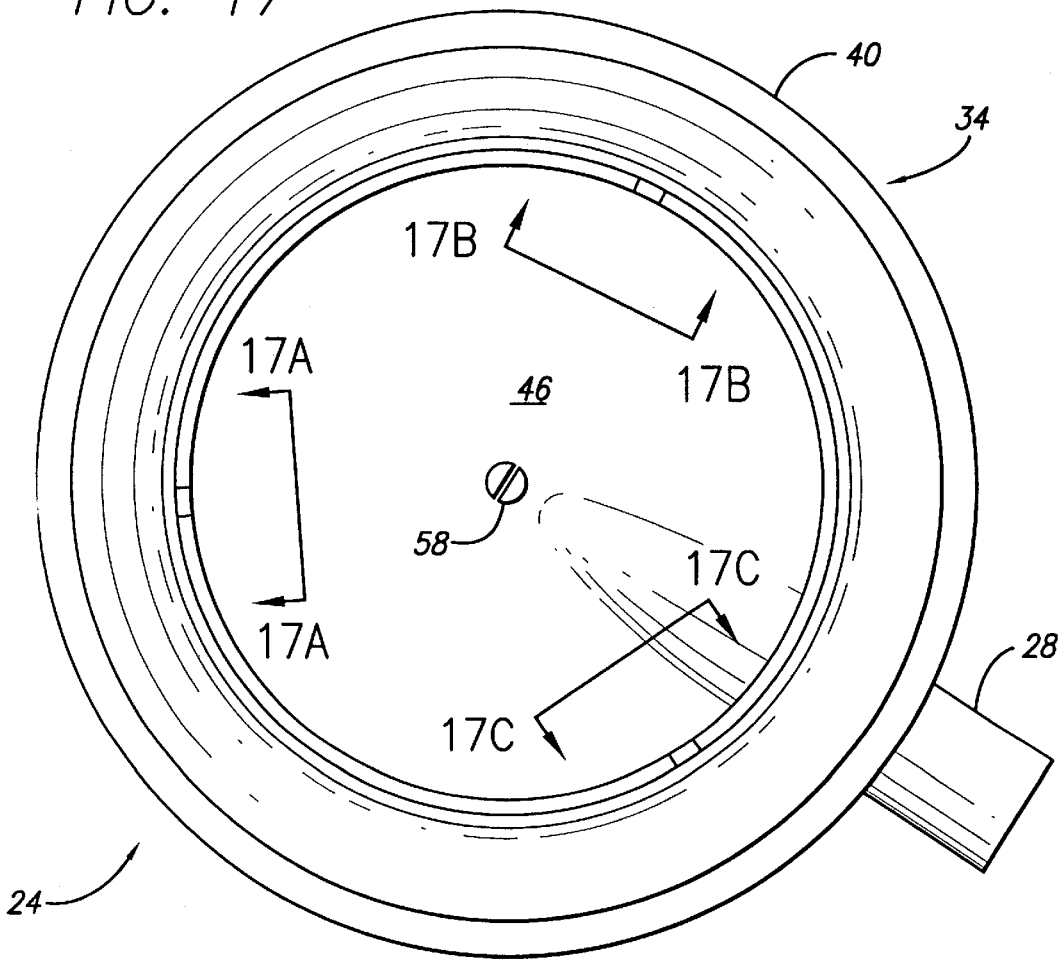
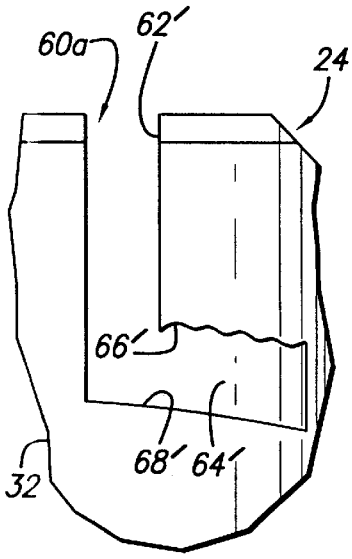
FIG. 17A
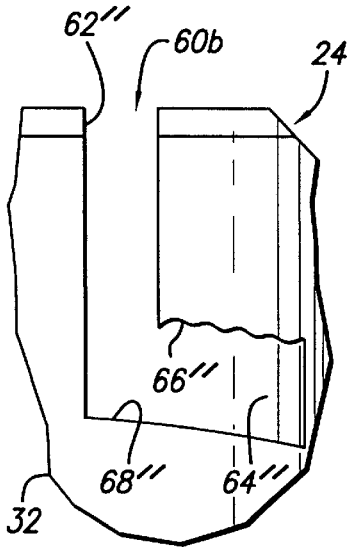
FIG. 17B
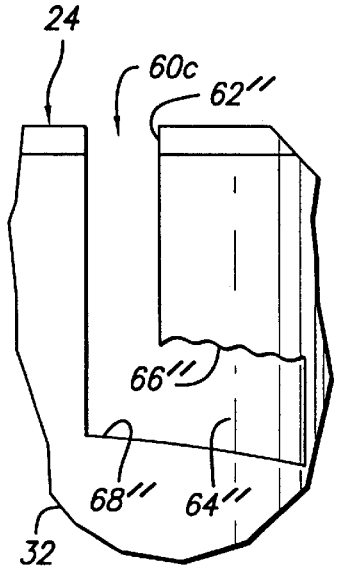
FIG. 17C

HORIZONTAL-FLOW TRAP AND HOUSING ASSEMBLY WITH ODOR PREVENTING CLOSURE MECHANISM

CROSS-REFERENCE TO RELATED APPLICATION

This application claims the benefit, and is a continuation-in-part of U.S. Provisional Application No. 60/263,321, filed Jan. 22, 2001, which is a continuation-in-part of application Ser. No. 09/515,870 filed Feb. 29, 2000 now abandoned.

REFERENCE REGARDING FEDERAL SPONSORSHIP

Not Applicable

REFERENCE TO MICROFICHE APPENDIX

Not Applicable

1. Field of the Invention

The present invention relates to a horizontal-flow trap and housing assembly and, in particular, to such an assembly with an odor preventing closure mechanism and improvements in the engagements and disengagements, and sealing, between the odor trap cartridge and the housing.

2. Description of Related Art and Other Considerations

So-called "waterless urinals" such as described in U.S. Pat. No. 6,053,297, have been devised to conserve water. Thus, there is interest in toilets and urinals designed to minimize the amount of water consumed in flushing, to mitigate excessive demands on both water supplies and wastewater disposal systems, both of which have tended to become overloaded with increasing populations.

The solution advanced in constructions such as described in U.S. Pat. No. 6,053,297 utilizes a cartridge or container accommodated in a housing. The housing has an exit tube which is connected to a sewer line. The cartridge includes an oil-sealed odor trap. The wastewater enters the cartridge through an opening in its top wall and exits through an opening in its bottom wall. When the cartridge is properly held in its housing, the cartridge exit opening is aligned with the housing exit tube and the flow of wastewater proceeds smoothly. However, if the two exits are misaligned, such flow is interrupted and becomes turbulent and the turbulence created in the wastewater may adversely affect proper operation of the cartridge.

A need has also arisen to provide a closure for the housing exit tube when the cartridge is not in place, such as to replace a spent cartridge with a new one. Such a closure prevents sewer gasses from escaping into a habitable room.

With respect to removal and replacement of cartridges, the tool used therefor must provide a secure and firm grip with the cartridges, and be easy to manipulate.

Furthermore, it is desirable that the cartridge be firmly sealed within the housing, and be easily insertable into and removable therefrom. While existing constructions have operated satisfactorily, improvements are also desired to assure insertion and removal.

It has also been discovered that not all exit tubes from the housing are dimensioned to fit all sizes of external drain fittings.

SUMMARY OF THE INVENTION

These and other problems are successfully addressed and overcome by the present invention. The housing and the cartridge are provided with a mutually engageable implementations which accurately define positions of initial unsecured and final secured interconnections between the two. These implementations ensure that the housing exit tube and the cartridge exit opening are at least aligned at the position of final secured interconnection. Such implementations preferably utilize a key and keyway interconnection system which not only defines the secured and unsecured positions but also ensures the proper orientation of the cartridge with respect to the housing, thereby to avoid any possible misalignment between the housing exit tube and the cartridge exit opening. The key and keyway interconnection system also includes contrivances for firmly retaining the cartridge within the housing (e.g., a ratchet-type engagement) and for facilitating disassembly of the cartridge from the housing (e.g., by a ramp).

Blockage at the housing exit tube is facilitated by a closure mechanism which is associated with the housing and which is coupled to the cartridge so that, when the cartridge is moved from its secured to its unsecured position, the closure mechanism moves to seal off the exit tube.

Relative movements between the cartridge and the housing are facilitated by a tool which engages the wastewater openings in the cartridge and which enables turning of the cartridge with respect to the housing. Specifically, a latching mechanism between the tool and the cartridge provides a secure and firm grip therebetween, especially when the cartridge is to be removed from the housing.

Several advantages are derived from this arrangement. Alignment between the cartridge exit opening and the housing exit tube is assured. The exit tube is closed when the cartridge is not fully seated in the housing, to prevent unpleasant sewer gasses from entering the housing. Removal and insertion of the cartridge from and into the housing is facilitated.

Other aims and advantages, as well as a more complete understanding of the present invention, will appear from the following explanation of exemplary embodiments and the accompanying drawings thereof.

BRIEF DESCRIPTION OF THE DRAWINGS

FIG. 16 is a bottom view of the odor trap cartridge and its keys.

FIGS. 16A, 16B and 16C are views of the keys depicted in FIG. 16, taken respectively along lines 16A—16A, 16B—16B and 16C—16C thereof.

FIG. 17 is a top view of the housing.

FIGS. 17A, 17B and 17C are views of the keyways depicted in FIG. 17, taken respectively along lines 17A—17A, 17B—17B and 17C—17C thereof.

DETAILED DESCRIPTION

Figure 1:
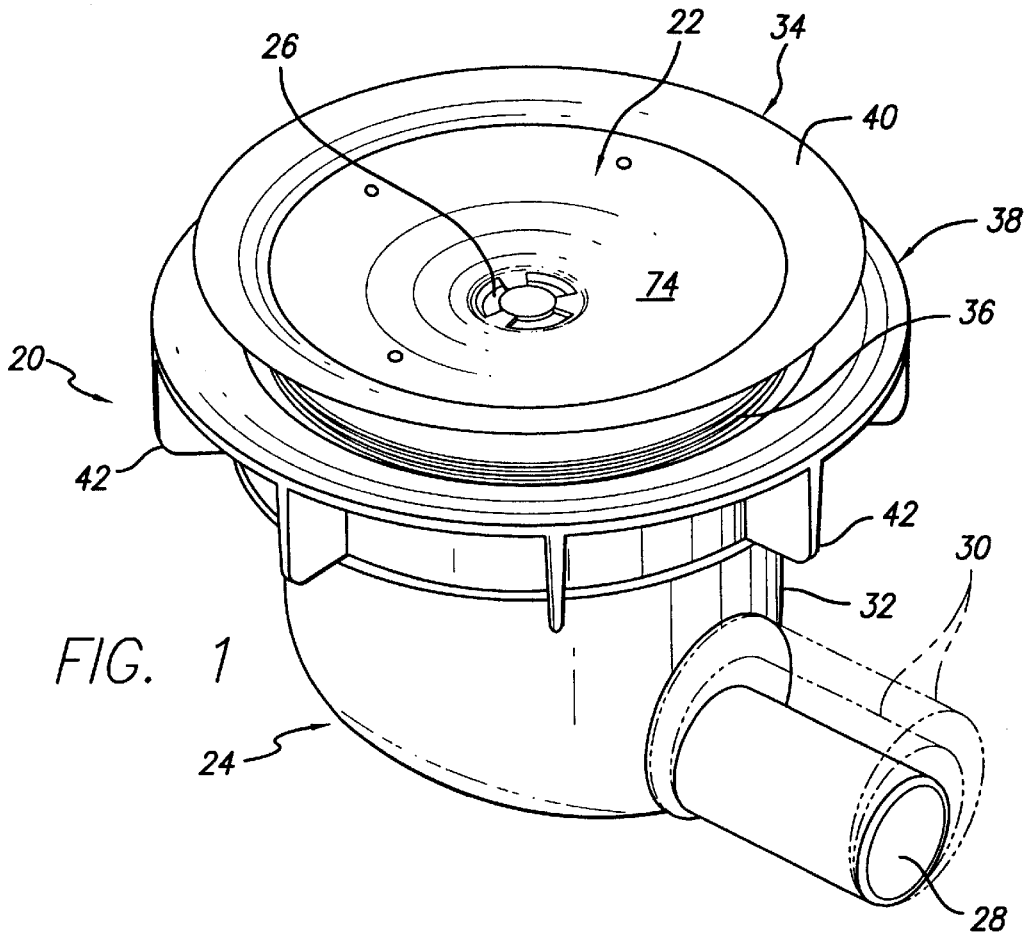
FIG. 1 depicts a perspective view of the present invention including an odor trap insert or cartridge positioned within a housing, having an exit tube coupled to a sewer disposal. The housing may comprise a portion of a urinal or entry in a floor. Fittings on the exit tube are shown in phantom for adapting the housing to different pipes.

Accordingly, a horizontal-flow trap and housing assembly 20 with odor preventing closure mechanism comprises an odor trap cartridge 22 which is disposed to be inserted within and removed from a housing 24. Cartridge 22 may take any convenient form, such as those which are disclosed in U.S. Pat. No. 6,053,197. Urine enters the cartridge through entry opening 26, and exits from the housing through an exit tube 28. The exit tube is coupled to drains leading to a waste disposal repository, as required by sanitation laws and regulations. To enable assembly 20 to be coupled to any size of drain that exists throughout the world, exit tube 28 and housing 24 are configured to receive a plurality of differently sized fittings 30, shown in phantom, whose dimensions conform to those of all countries.

Figure 2:
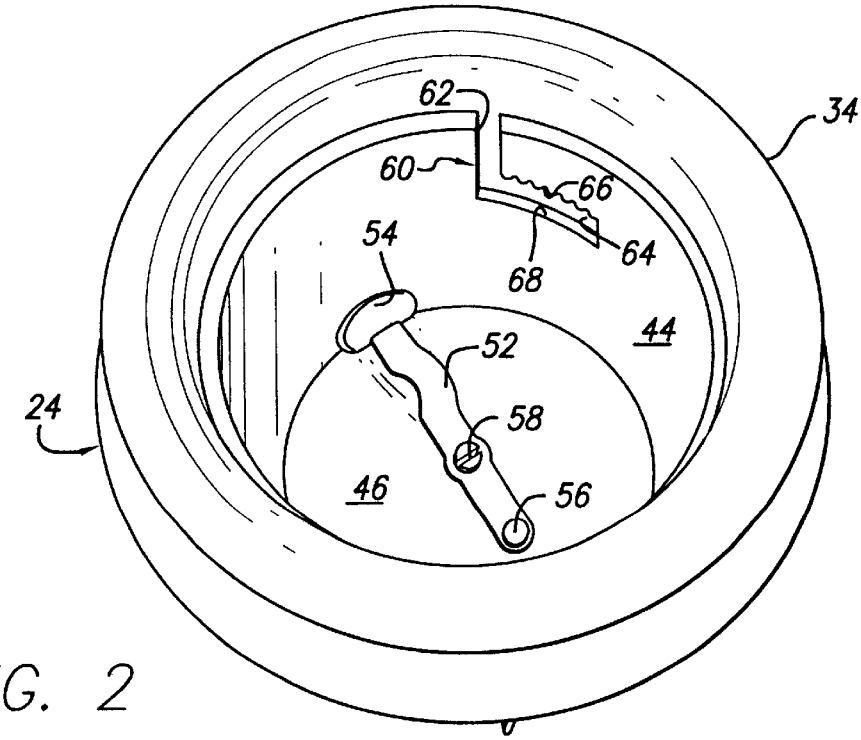
FIGS. 2 and 2A illustrate an interior portion of the housing shown in FIG. 1, and are particularly directed to an odor-blocking swivelable lever and cap to portray the respective covering and uncovering of the entrance to the exit tube in the housing. Specifically, the covering occurs when the odor trap cartridge is not fully operationally engaged within the housing, and the uncovering proceeds when the odor trap cartridge is moved to be fully operationally engaged within the housing. While the swivelable lever may be removed, is desired, its use is preferred.
Figure 2A:
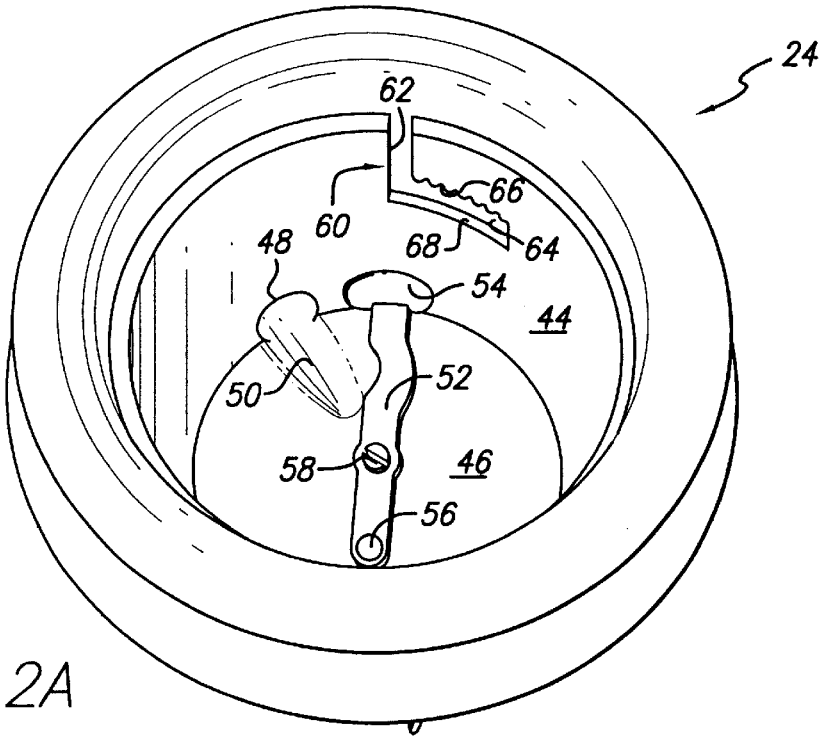
Figure 7:
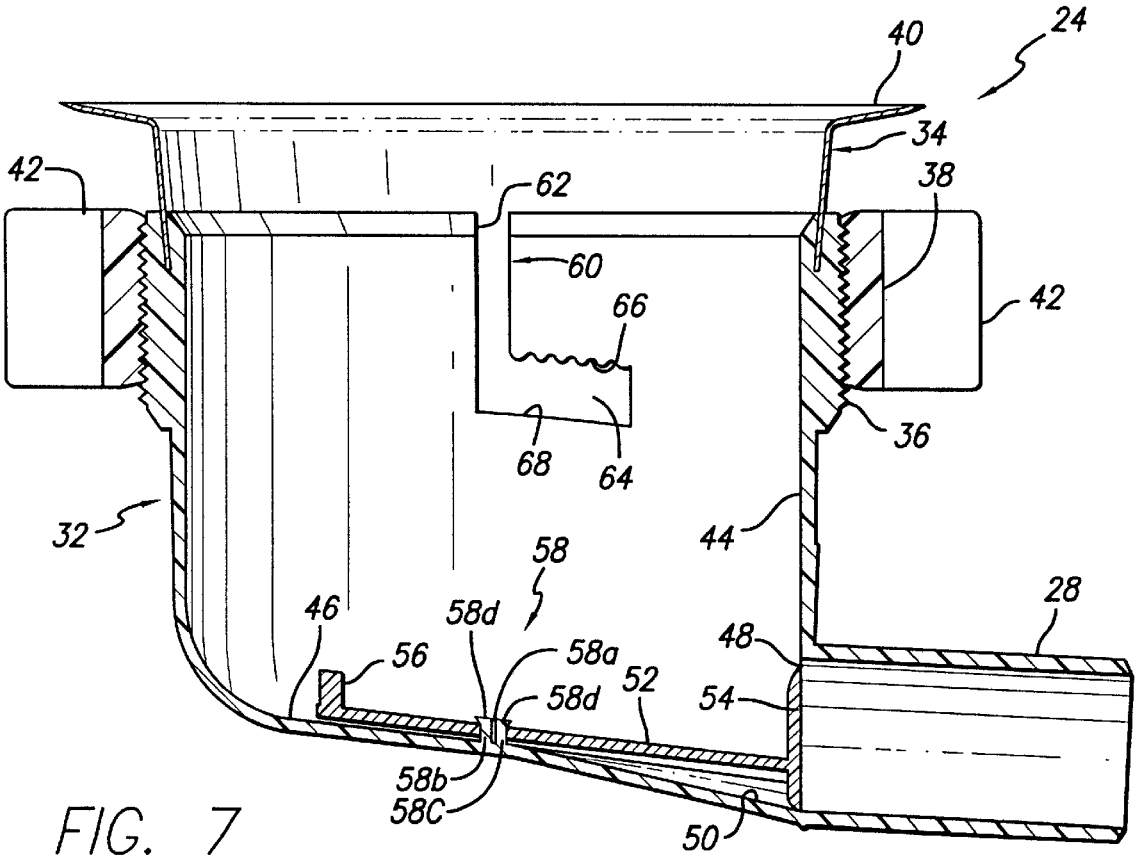
FIG. 7 is a cross-sectional view of the housing depicted in FIG. 2.

As best shown in FIG. 7 (but see also FIGS. 1–3) housing 24 includes a body 32 to which a flange 34 is secured by any suitable means, such as by a molding process. Body 32 is provided with external threads 36 onto which a nut 38 is threaded. Flange 34 includes a lip 40 which is adapted to rest upon a support so that the combination of flange 34 and nut 38 will permit housing 24 and, therefore, assembly 20 to be secured firmly in place to a support, such as a floor or a part of a urinal. Nut 38 includes a plurality of fin-like extensions 42 which may be gripped by a user's fingers to thread the nut onto body 32. Lip 40 is sloped towards odor trap cartridge 22 to direct urine into the cartridge.

Figure 4:
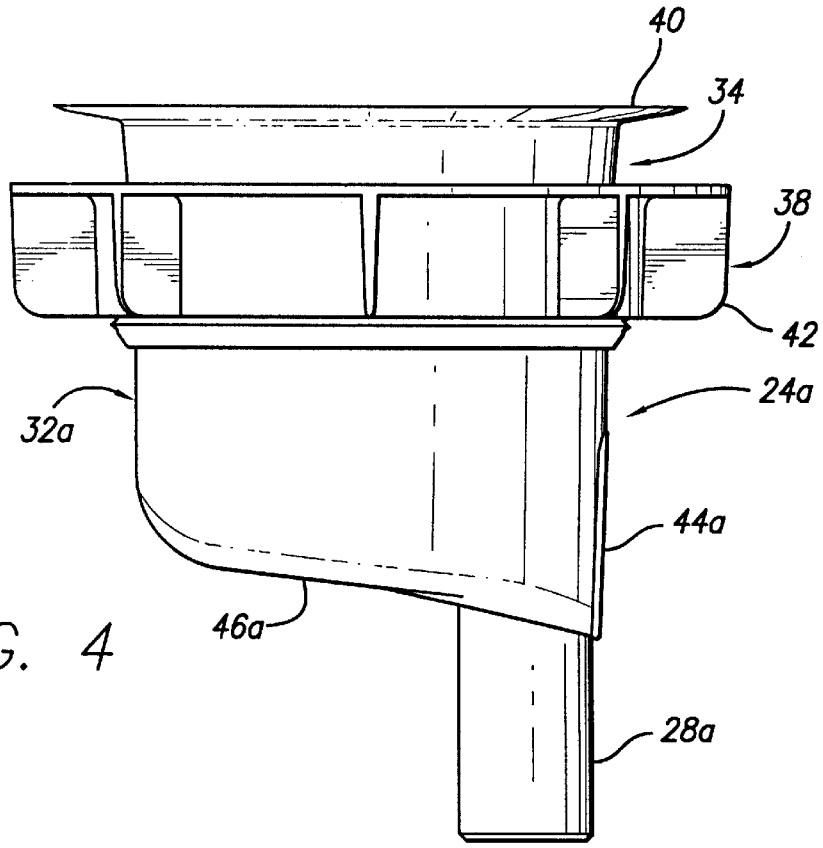
FIGS. 4 and 5 depict alternate arrangements of the exit tube extending from the housing.
Figure 5:
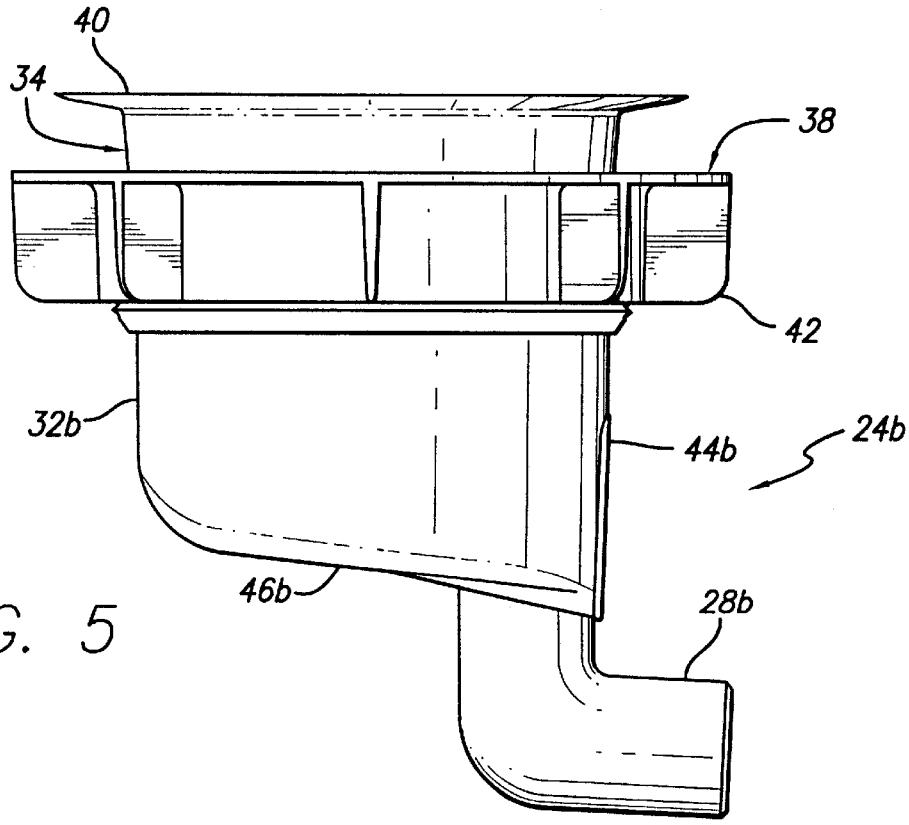
Figure 6:
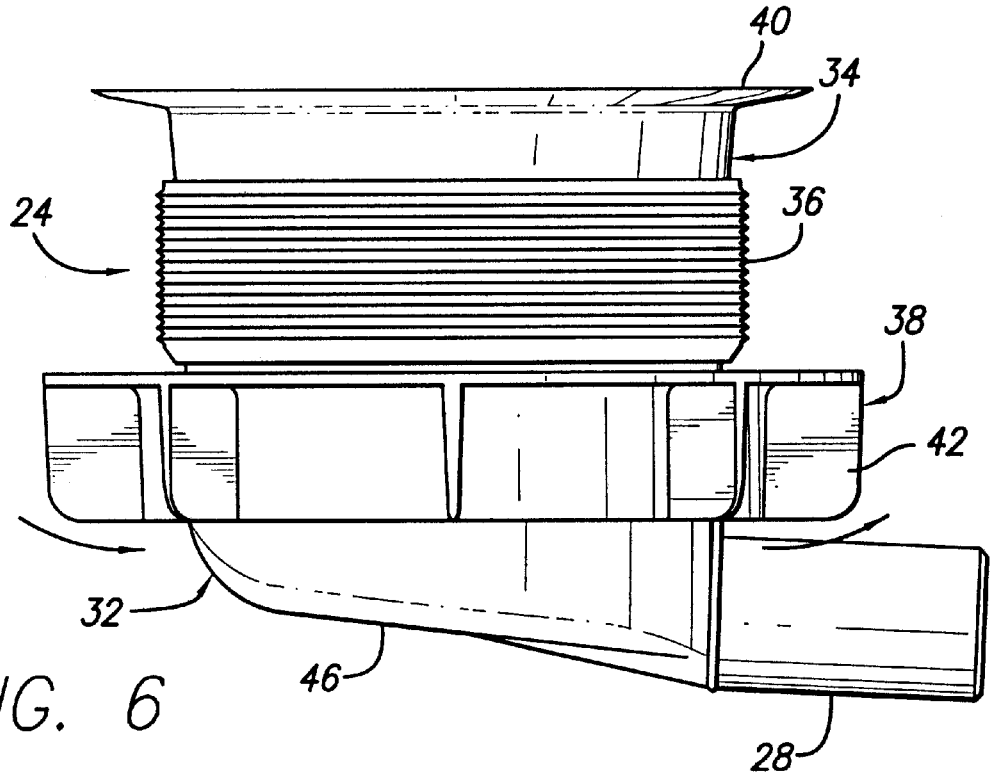
FIGS. 6 and 6A illustrate the means by which the present invention may be secured to a urinal structure.
Figure 6A:
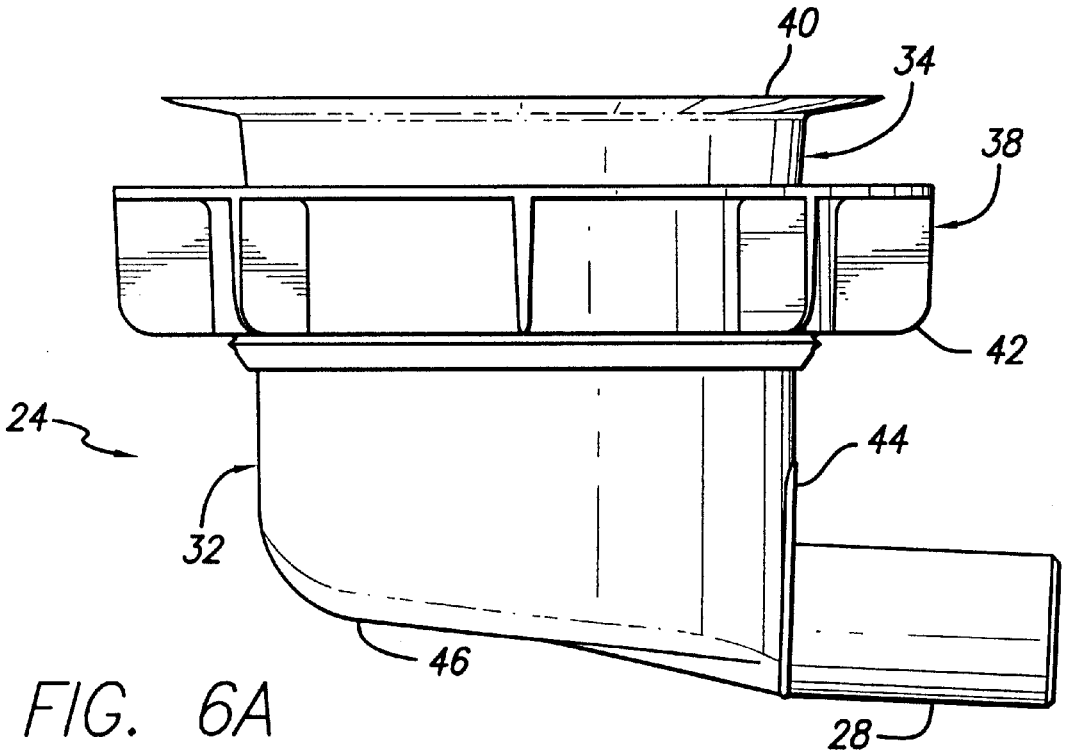

Housing body 32 comprises a tubular wall 44, onto which threads 36 are formed, and a bottom wall 46. In one embodiment as depicted in FIGS. 1, 3, 6–8 and 17, exit tube 28 extends from the tubular wall, extending from an opening 48 therein. In other embodiments as shown in FIGS. 4 and 5, housings 24*a* and 24*b* are provided respectively with exit tubes 28*a* and 28*b* extending from their bottom walls 46*a* and 46*b*, rather than from their tubular walls 44*a* and 44*b*. In all embodiments, bottom walls 46, 46*a* and 46*b* are sloped towards exit tubes 28, 28*a* and 28*b* to encourage drainage of urine into their respective exit tubes. In at least one of the embodiments, as best depicted in FIGS. 2A, 3, 7 and 8A–8D, an increasingly deepening U-shaped depression 50 is formed in bottom wall 46 to aid in the liquid flow and, more importantly, to accommodate an important odor-blocking feature of the present invention.

This odor-blocking feature is effected by use of a lever 52 having a cap 54 and a projection 56 at opposed ends thereof. Lever 52 is mounted on a pivot 58 extending from bottom 46 of housing body 32, and is swivelable about the pivot to cover or uncover opening 48 leading to exit tube 28. When cap 54 is positioned to cover opening 48, any unpleasant odors from the sewer gasses are blocked from entering housing 24 and beyond. Such covering and uncovering is dependent upon the operative positioning of odor trap cartridge 22 in the housing, which positioning will be explained hereinafter in conjunction with the description of the cartridge. As shown in FIG. 7, pivot 58 is provided with a slot 58*a* which forms a pair of mount halves 58*b* and 58*c* having a bifurcated T-shaped flange 58*d*. This pivot effects mounting of lever 52 onto bottom 46. Mount halves 58*b* and 58*c* are adapted to slightly flex towards one another to permit lever 52 to be snapped over bifurcated flange 58*d* and, thus, to secure the lever on bottom 46, which is the preferred assembly. However, to accommodate parties not desiring use of the lever, lever 52 may be removed simply by snapping it from its mounting engagement on pivot 58 as enabled by the flexibility of mount halves 58*b* and 58*c*.

Figure 3:
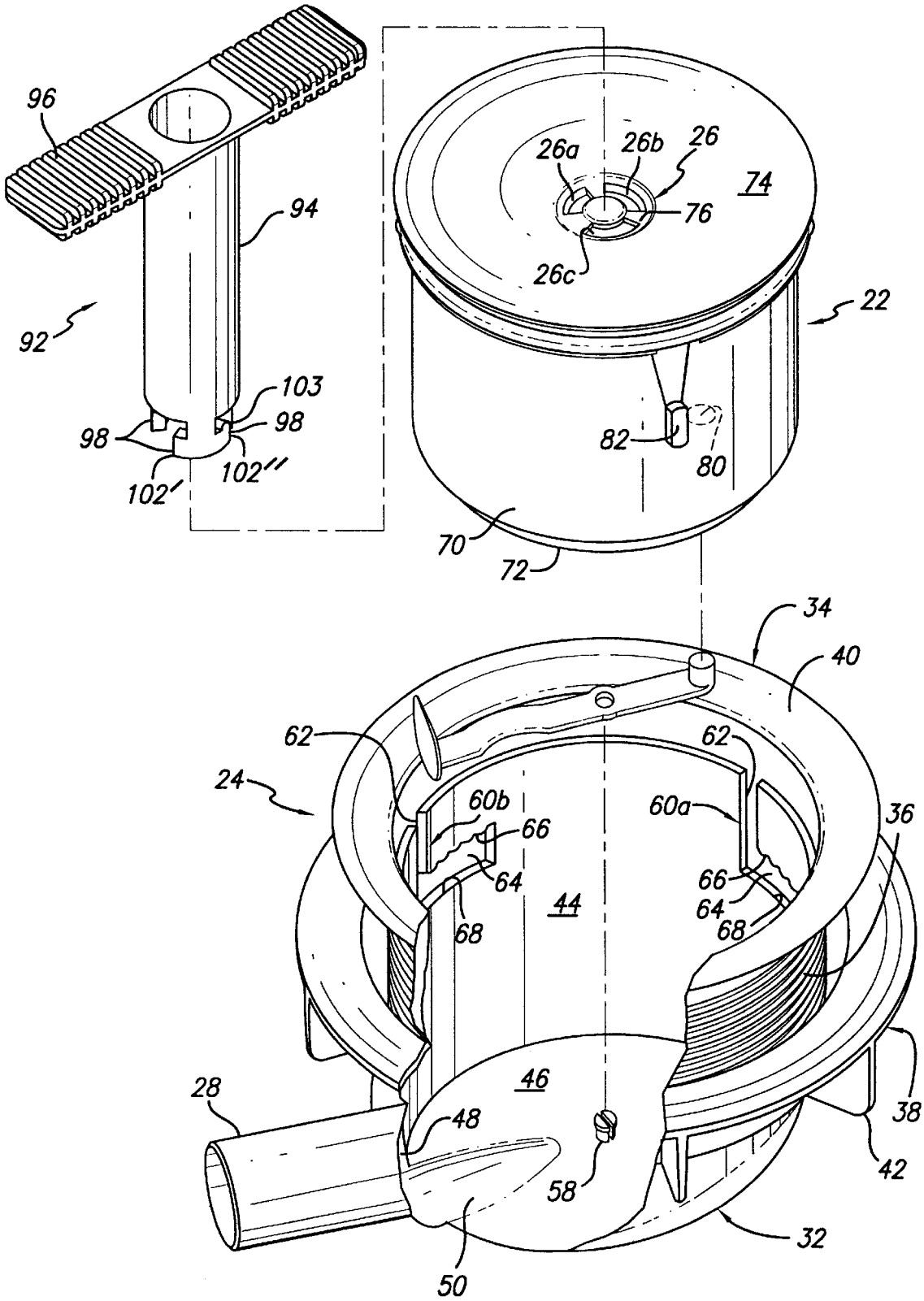
FIG. 3 is an exploded view of the present invention showing the arrangement of the odor trap cartridge with respect to the housing, the positioning of the odor trap cartridge with respect to its coupling with and maneuvering of the odor-blocking swivelable lever and cap, and a plug member tool which is engageable with the odor trap cartridge for insertion and removal of the cartridge into and from the housing.

Housing body 32 is further provided with three L-shaped keyways 60*a*, 60*b* and 60*c*, as best illustrated in FIGS. 17 and 17A–17C, which are generally shown as a keyway 60 in FIGS. 2, 2A, 7 and 8A–8D and two keyways 60*a* and 60*b* in FIG. 3. The keyways are formed in the interior surface of tubular wall 44 but they do not extend fully through the wall. Keyways 60*a*, 60*b* and 60*c* are spaced unequally from one another within tubular wall 44, that is, at disparate angles from one another which are not spaced 120° from one another. Each keyway includes a vertical component 62' or 62" and a generally horizontal component 64' or 64" in FIGS. 17A–17C (in FIGS. 2, 2A, 3, 7 and 8A–8D the generally horizontal component is commonly identified by indicium 64).

The difference between vertical components 62' and 62" is that the former has a lesser depth than that of the latter. The difference between generally horizontal components 64' or 64" is that component 64' has a lesser vertical height than component 64".

Each generally horizontal component 64' and 64" is provided with an upper corrugated surface 66 and a lower smooth surface 68. Both surfaces 66 and 68 are generally parallel to one another, and both slope slightly downwardly as they extend further away from their vertical components 62. As previously stated above, the import of the differently configured keyways 60*a*, 60*b* and 60*c* are dependent upon the operative positioning of odor trap cartridge 22 in the housing, which positioning will be explained hereinafter in conjunction with the description of the cartridge.

Cartridge 22 (see FIGS. 3, 8A–8D and 12) has a cylindrical configuration defined by a tubular wall 70 terminated by a bottom wall 72 and a top wall 74. The top wall is sloped downwardly to a flat, generally horizontal flat center portion 76 in which entry opening 26 is disposed, and extends from lip 40 of housing flange 34 (see FIG. 3) to direct the flow of liquid into the cartridge. As further depicted in FIGS. 9–15, opening 26 comprises a tripartite arrangement of three arced slots 26*a*, 26*b* and 26*c*, as best shown in FIG. 3. As illustrated in FIG. 16, bottom wall 72 includes an exit or lower opening 78, as distinguished from entry or upper opening 26 (FIGS. 8A–8D), for discharge of fluids from cartridge into exit tube 28. When the cartridge is properly inserted into the housing, exit opening 78 will be aligned with opening 48 in housing 24 to its exit tube 28.

Figure 9:
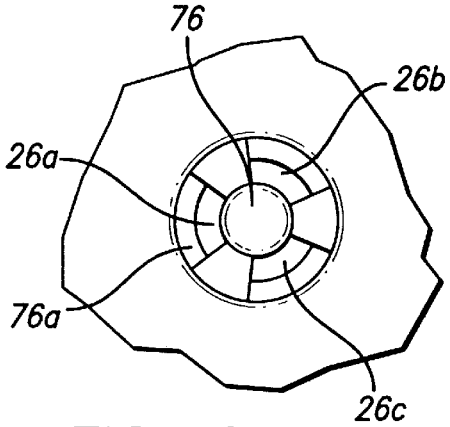
FIG. 9 is a view of the top wall of the cartridge taken from its outside surface.
Figure 10:
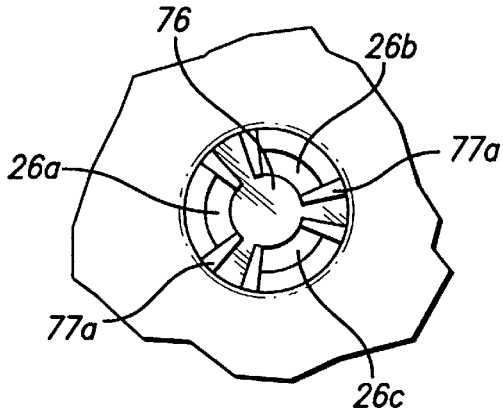
FIG. 10 is a view of the top wall of the cartridge taken from its inside surface.
Figure 11:
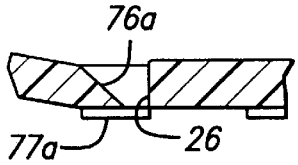
FIG. 11 is a cross-sectional view of the top wall of the cartridge taken along line 11—11 of FIG. 8A.
Figure 12:
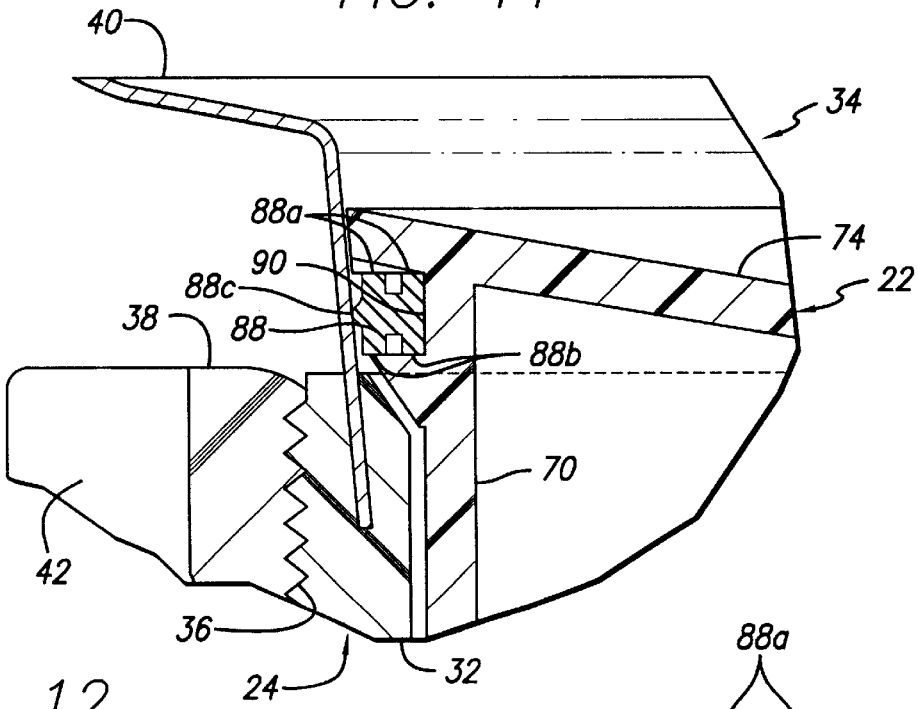
FIG. 12 is an exploded view of the engagement of portions of the odor trap cartridge and the housing and a sealing O-ring.
Figure 12A:
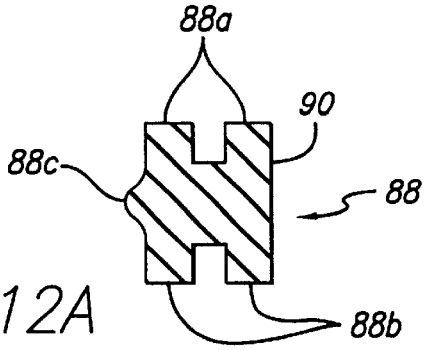
FIG. 12A is a cross-sectional view of the O-ring prior to being its being inserted within a groove in the cartridge.

Details of opening 26 and its three slots 26*a*, 26*b* and 26*c*, and generally horizontal flat center portion 76 of top wall 74 are illustrated in FIGS. 9–11. Flat center portion 76 of the top wall is depicted as having opposed upper and under surfaces 76*a* and 77. As shown in FIGS. 9 and 11, upper surface 76*a* of center portion 76 is sloped or curved towards the entries to openings 26*a*, 26*b* and 26*c*, or the openings are beveled to encourage flow of liquid into the openings and to prevent retention of any liquid due to surface tension effects. As shown in FIG. 10, undersurface 77 is provided with downwardly extending protuberances 77*a* adjacent one side of each opening 26*a*, 26*b* and 26*c*. The purposes of protuberances 77*a* will be fully explained shortly with respect to FIGS. 13–15.

A small off-center blind hole 80 also extends into bottom wall 72 but not through the bottom wall, and is adapted to engage projection 56 on lever 52.

Cartridge 22 is further provided with three keys of which one is designated with indicium 82' and two are designated with the same indicium 82", as best illustrated in FIGS. 16 and 16A–16C, which are generally shown as a keyway 82 in FIGS. 3 and 8A–8D. Like keyways 60*a*, 60*b* and 60*c*, all three keys 82' and 82" are spaced unequally from one another within cartridge 22, that is, at disparate angles from one another which are not spaced 120° from one another. Their angular orientation, however, exactly matches those regarding keyways 60*a*, 60*b* and 60*c*. As best shown in FIGS. 16A–16C, key 82' has a vertical dimension which is less than those of both keys 82". Furthermore, key 82' is mated to engage keyway 60*a* while keys 82" are respectively mated to engage respective keyways 60*b* and 60*c*. The heights of the keys are so coordinated with the heights of their respective keyways in that their respective contacts result in an interference fit therebetween. To encourage a facile engagement, the keys are rounded at their top surfaces 84 and bottom surfaces 86. Thus, top surfaces 84 and bottom surfaces 86 of the keys are disposed to respectively contact corrugated and smooth surfaces 66 and 68 of the keyways. Furthermore, the figures illustrating the keys and keyways are paired to form pairings of FIG. 16A with FIG. 17A, FIG. 16B with FIG. 17B, and FIG. 16C with FIG. 17C.

To provide a proper sealing between cartridge 22 and housing 24, as shown in FIGS. 8A–8D and 12, an O-ring 88 is positioned within an annular groove 90 in cartridge 22, adjacent its top wall 74. The sealing engagement provided by O-ring 88 is enhanced, as more clearly shown in FIG. 12, by configuring the O-ring with two pairs of upwardly and downwardly extending annular ridges 88*a* and 88*b* and an outwardly extending annular projection 88*c*. Ridges 88*a* and 88*b* furnish larger areas of engagement with annular groove 90.

Figure 13:
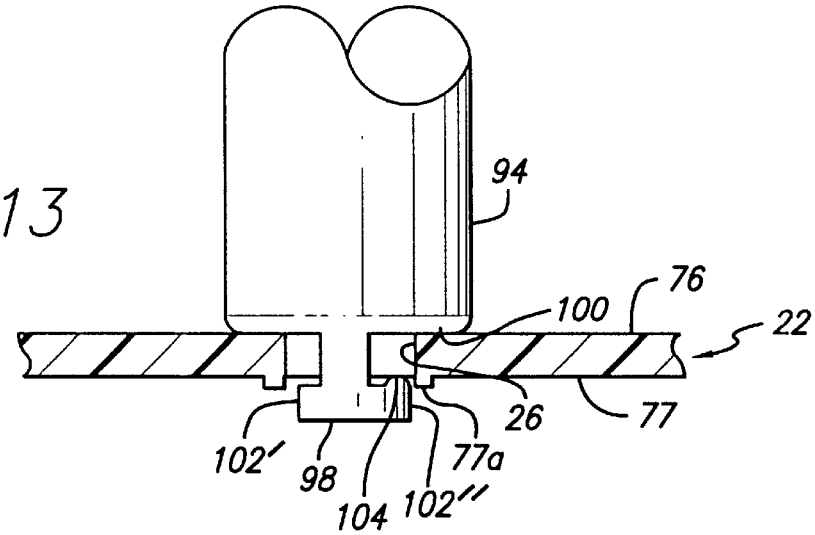
FIGS. 13–15 illustrate employment of the plug member tool and its engagement with the odor trap cartridge for enabling insertion and removal of the cartridge into and from the housing.
Figure 14:
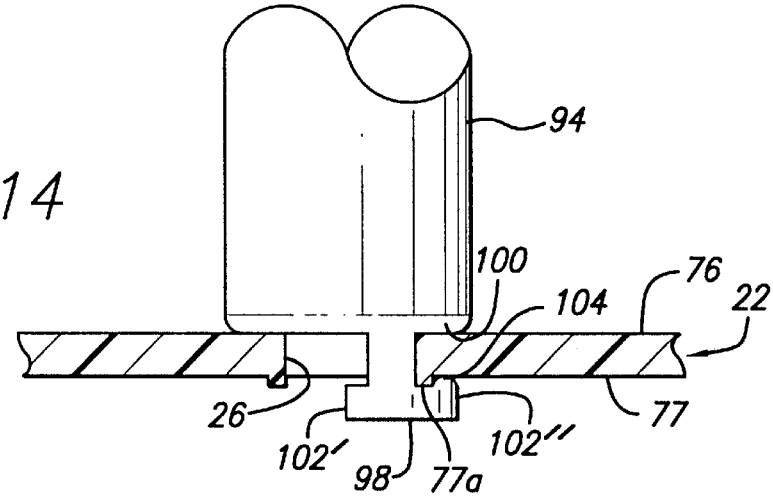
Figure 15:
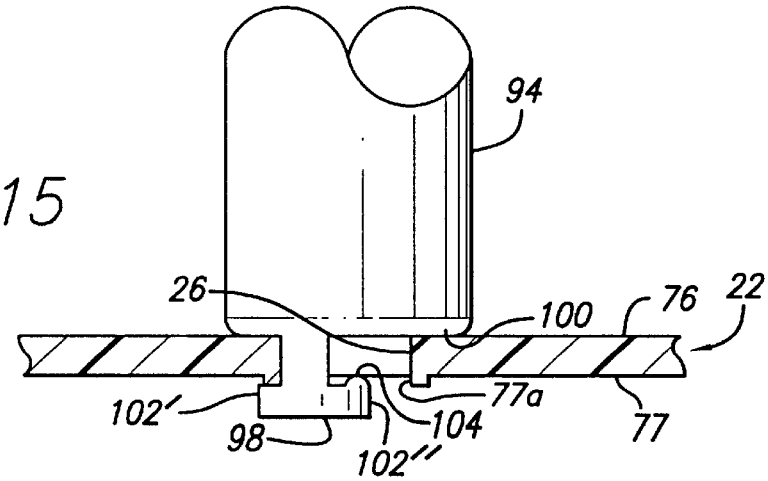

Insertion and withdrawal of the cartridge in and from the housing is facilitated by use of a tool 92, shown in FIGS. 3 and 13–15. The tool includes a shank 94, a handle 96 at one end, and three arced T-shaped projections 98 which extend from a surface 100 (see FIGS. 13–15) at its opposed end. The T-shaped projections are provided with appendages 102' and 102" of unequal length, with appendage 102' being shorter than appendage 102". FIG. 13 depicts insertion of T-shaped projection into an opening 26. FIG. 14 illustrates use of tool 92 to remove the cartridge from the housing, and FIG. 15 illustrates use of tool 92 to insert the cartridge into the housing. The distinctions between use of the tool for cartridge insertion and removal lies in the cooperative engagement of appendages 102' and 102" in openings 26. Specifically, when the cartridge is to be removed from the housing, it is desired that there be a greater surface engagement between the tool appendage and the undersurface (designated by indicium 77) of flat center portion 76; this extended surface engagement is provided by larger appendage 102". For insertion purposes, however, appendage 102' is needed only for a minimum locking between the tool and the cartridge, inasmuch as the insertion force is defined by contact between tool surface 100 and cartridge flat center portion 76.

To assure a firm engagement of tool appendages 102", in particular, with flat center portion 76 of cartridge top wall 74, an interlock is formed between appendages 102" and undersurface 77 of center portion 76. This interlock is provided by downwardly extending protuberances 77*a* on undersurface 77 and upwardly extending protuberances 104 on appendages 102". When appendages 102" are moved to their positions as depicted in FIG. 14, a locking engagement is effected between tool 92 and cartridge 22 to resist unintentional disengagement of these parts.

In operation and with reference to FIGS. 8A–8D, when it is desired to insert cartridge 22 into housing 24, projections 98 of tool 92 are inserted into openings 26 of the cartridge, as described above. The cartridge is inserted into the housing, and turned until key 82' and keys 82" are aligned with their respective keyways 60*a*–60*c*. This alignment also provides a proper registration between the two different depths of keyways with respect to the two different heights of the keys. The result is a dual alignment system that ensures that the cartridge will properly fit into and be aligned with the housing. This alignment further ensures that exit opening 78 of cartridge 22 will be aligned with opening 48 in housing 24 and its exit tube 28.

Figure 8A:
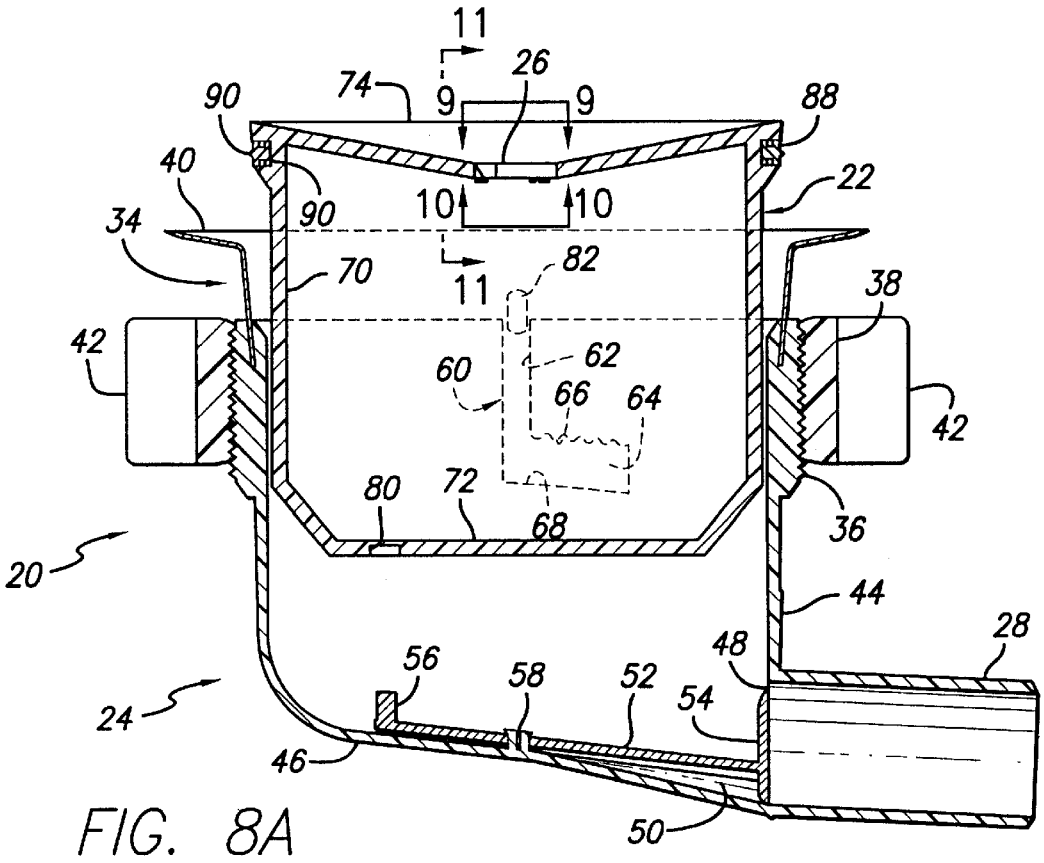
FIGS. 8A–8D illustrate, in seriatim, the steps of engagement and the implementation utilized therein of the odor trap cartridge with the housing, encompassing the uncovering of the entrance to the exit tube by odor-blocking swivelable lever and cap. The implementation includes keys on the cartridge and keyways in the housing for locking these two components together when assembled and for encouraging unlocking when disassembled.
Figure 8B:
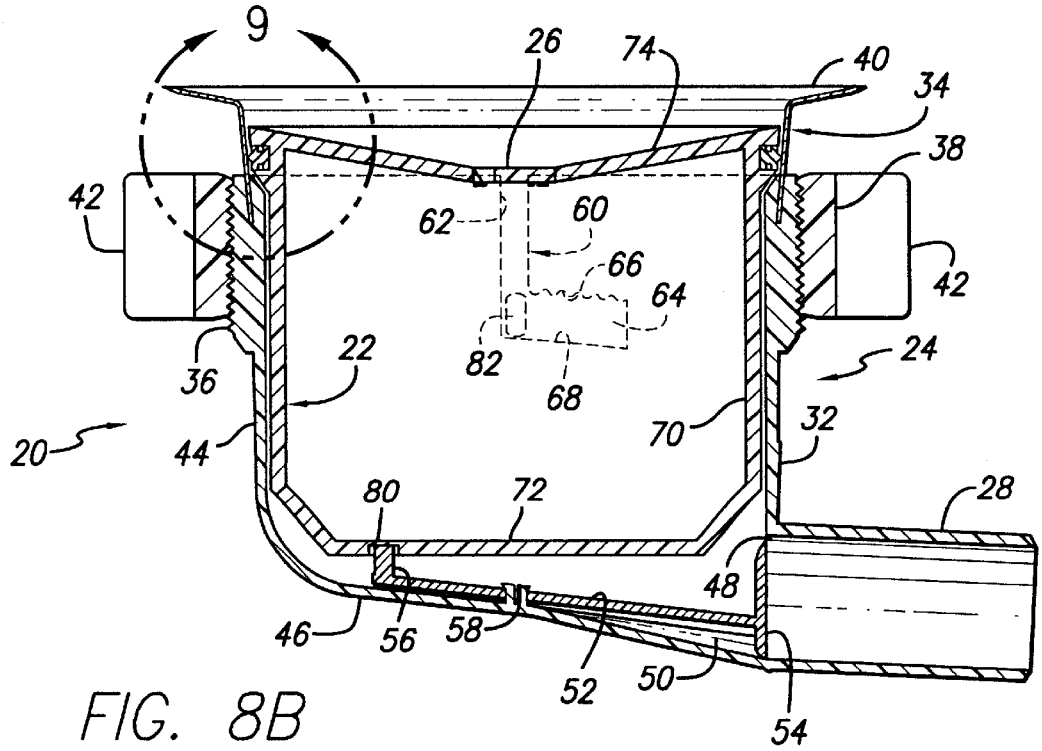
Figure 8C:
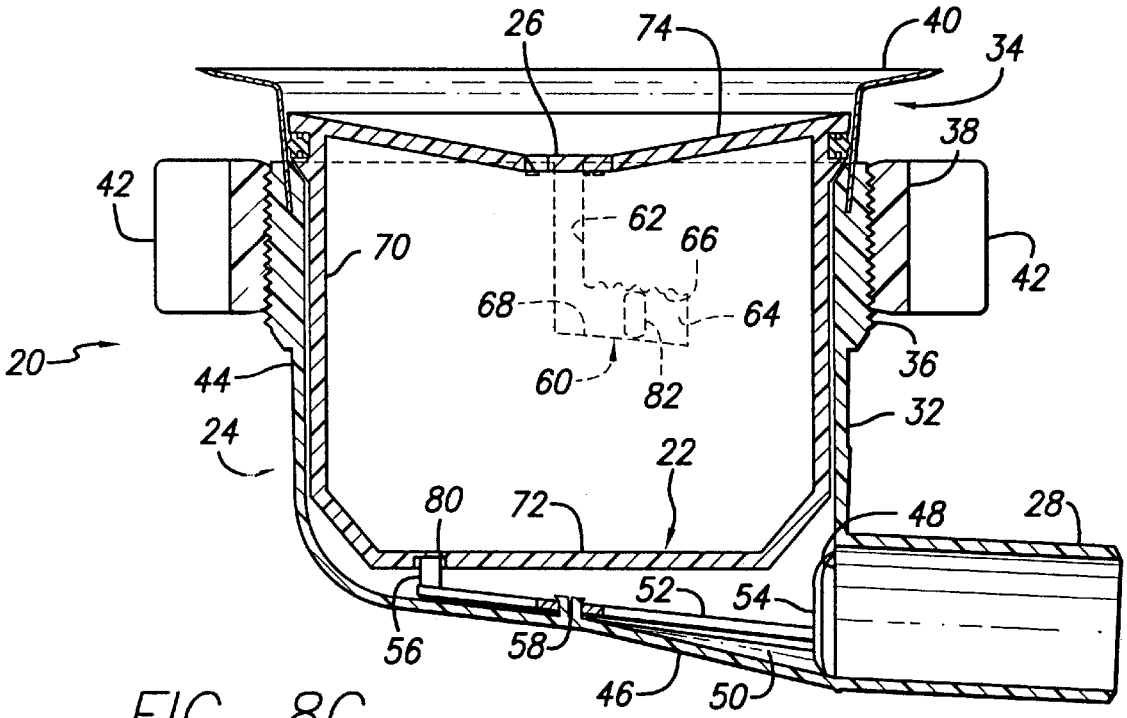
Figure 8D:
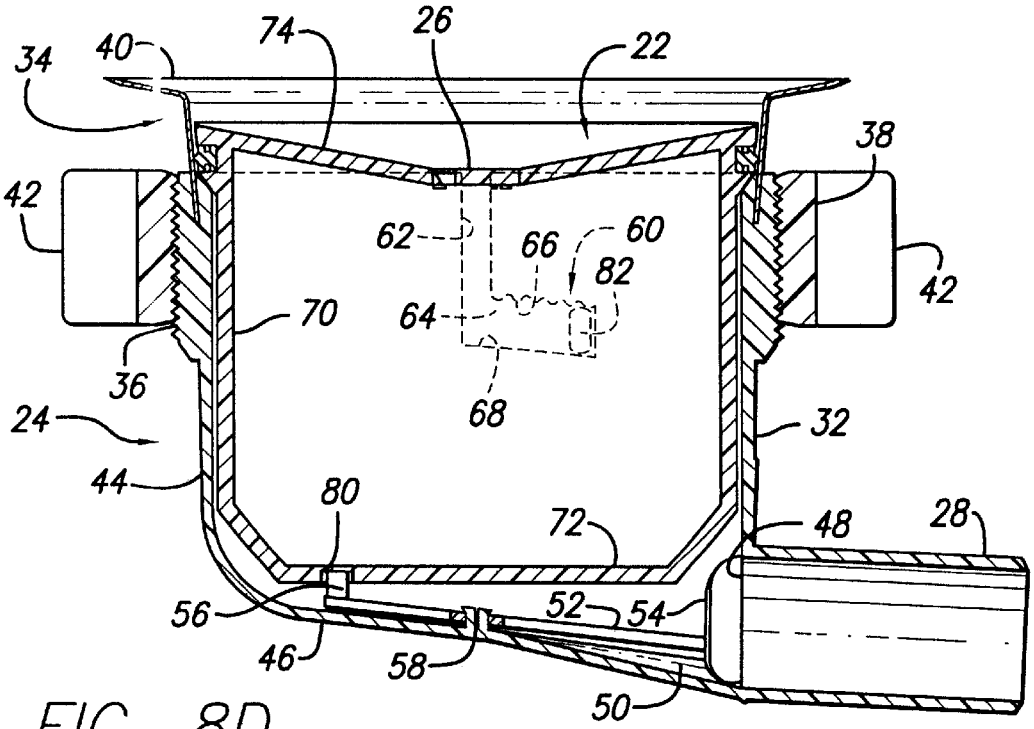

When the keys are properly ordered with their mating keyways as shown in FIG. 8A, cartridge 22 will be positioned with respect to housing 24, and will permit the cartridge to be pushed into the housing as illustrated in FIG. 8B. At this point, offcenter hole 80 in cartridge bottom wall 72 will be aligned with projection 56 of lever 52, and keys 82 will rest on smooth surface 68 at the entrance of horizontal keyway components 64. The cartridge will then be in position to be turned by tool 92, as depicted in FIGS. 8C and 8D. This turning causes lever 52 to swivel, through the engagement between hole 80 and projection 56, and to move cap 54 away from covering opening 48. During this turning operation, the top surfaces 84 of the keys will ratchet against their respective corrugated surfaces 66 and lock the cartridge within the housing. Simultaneously, O-ring 88 will be deformed into a sealing engagement between these two parts.

When it is desired to remove the cartridge from the housing, tool 92 and its appendages 102" are engaged within openings 26. A turning of the tool will move keys 82 along inclined smooth surfaces and provide a camming process so as to facilitate separation of the cartridge from the housing. The resiliency of O-ring 88 will also provide a separation force.

Although the invention has been described with respect to particular embodiments thereof, it should be realized that various changes and modifications may be made therein without departing from the spirit and scope of the invention.

What is claimed is:

1. In an odor trap apparatus for conveyance of wastewater to an external drain, including a housing (32) having an interior and an opening (48) extending from the interior to the external drain, and a cartridge (22) having an exterior and receivable in the housing interior, and an opening (26) for receiving the wastewater, and an exit opening (78) disposed to communicate with the housing opening, the improvement comprising:

housing cartridge-engagement implementation (60) associated with the housing interior; and cartridge housing-engagement implementation (82) associated with the cartridge exterior, said housing and cartridge implementations having respective cooperative mechanisms for effecting an interengagement therebetween for securing said cartridge within said housing.

2. The improvement according to claim 1 in which said housing opening comprises a tube of given external dimension, and further including a plurality of fittings sized differently from the external dimension of said tube to enable said housing to be coupled to any size of fitting to the external drain.

3. The improvement according to claim 1, in which said implementations (60, 82) define positions of initial unsecured and final secured interconnections between said housing and said cartridge, and said housing opening (48) and said cartridge exit opening (78) are aligned at the position of final secured interconnection and misaligned at the position of initial unsecured interconnection, and further including a closure mechanism (52) for closing said housing opening (48) when said housing opening and said cartridge exit opening (78) are at other than the position of final secured interconnection, for blocking any unpleasant odors from sewer gasses from entering said housing.

4. The improvement according to claim 3, in which:

said housing and said cartridge are cylindrical in configuration; and said closure mechanism (52) comprises a lever having a swivelable coupling to said housing, a cap (54) on said lever sized to block said housing opening (48), and a coupling (56, 80) between said cartridge and said lever for enabling said lever to swivel when said cartridge is rotated with respect to said housing.

5. The improvement according to claim 4 in which said coupling between said cartridge and said lever comprises a projection (56) on said lever and a blind opening (80) in said cartridge.

6. The improvement according to claim 4 in which said swivelable coupling between said lever and said housing comprises a bifurcated pivot for enabling removal of said lever from said housing.

7. The improvement according to claim 1 in which:

said housing and said cartridge are cylindrical in configuration;

said housing cartridge-engagement implementation (60) comprises at least one L-shaped keyway having vertical and generally horizontal components (62, 64) joined at an intersection; and said cartridge housing-engagement implementation (82) comprises at least one key fittable within said L-shaped keyway.

8. The improvement according to claim 7 in which said generally horizontal component (64) is inclined downwardly from the intersection for enabling said key to act as a cam to facilitate separation of said cartridge from said housing.

9. The improvement according to claim 1 in which:

said implementations (60, 82) define positions of initial unsecured and final secured interconnections between said housing and said cartridge;

said housing and said cartridge are cylindrical in configuration;

said housing includes a bottom wall (46), a tubular wall (44) extending upwardly from said housing bottom wall, and an opening for receipt of said cartridge;

said cartridge (22) includes a top wall (74), a bottom wall (72) and a tubular wall (70) joining said top and bottom walls;

said cartridge housing-engagement implementation (82) comprises a plurality of keys; and said housing cartridge-engagement implementation (60) comprises a plurality of L-shaped keyways equal in number to said keys, which are fittable respectively therewithin, said keyways each having vertical and generally horizontal components (62, 64) extending from said housing cartridge-receiving opening and joined at an intersection, each of said vertical components defining the position of initial unsecured interconnection and extending downwardly from said housing cartridge-receiving opening towards said housing bottom wall, and each of said generally horizontal components (64), at its terminus opposed from the intersection, defining the position of final secured interconnection and being inclined downwardly from the intersection to facilitate, with said keys, separation of the cartridge from the housing.

10. The improvement according to claim 9 in which:

said housing opening (48) and said cartridge exit opening (78) are aligned at the position of final secured interconnection and misaligned at the position of initial unsecured interconnection;

said cartridge housing-engagement implementation (82) and said housing cartridge-engagement implementation (60) are angularly positioned unequally about the peripheries of their respective cartridge and housing to ensure alignment of said housing opening (48) and said cartridge exit opening (78) are aligned at the position of final secured interconnection.

11. The improvement according to claim 10 in which at least one of said keys and at least one of said mating L-shaped keyway horizontal keyways are horizontally dimensioned differently from at least one other of said keys and keyways said mating L-shaped keyway horizontal to ensure alignment of said housing opening (48) and said cartridge exit opening (78) are aligned at the position of final secured interconnection.

12. The improvement according to claim 9 in which at least one of said keys and at least one of said mating L-shaped keyway horizontal keyways are horizontally dimensioned differently from at least one other of said keys and keyways said mating L-shaped keyway horizontal to ensure alignment of said housing opening (48) and said cartridge exit opening (78) are aligned at the position of final secured interconnection.

13. The improvement according to claim 12 in which:

said housing opening (48) and said cartridge exit opening (78) are aligned at the position of final secured interconnection and misaligned at the position of initial unsecured interconnection;

said cartridge housing-engagement implementation (82) and said housing cartridge-engagement implementation (60) are angularly positioned unequally about the peripheries of their respective cartridge and housing to ensure alignment of said housing opening (48) and said cartridge exit opening (78) are aligned at the position of final secured interconnection.

14. The improvement according to claim 9 in which said horizontal components are respectively provided with corrugated surfaces for cooperation with said keys and, thereby, for enabling the cartridge to be locked within the housing at the position of final secured interconnection.

15. The improvement according to claim 1 wherein said cartridge (22) includes a top wall (74) in which the cartridge opening resides, and said top wall includes a sloped upper surface **(76*a*)** adjacent to the cartridge opening for beveling thereof to encourage flow of the wastewater into the cartridge opening and to prevent retention of any liquid on said top wall due to surface tension effects.

16. The improvement according to claim 1 wherein said cartridge (22) includes a top wall (74) which incorporates the cartridge opening, and wherein said cartridge opening entry includes a plurality of openings through which the wastewater passes, and further including:

a tool having hook-shaped projections therein for engagement with said openings for enabling insertion into, and removal of said cartridge from said housing.

17. The improvement according to claim 16 in which said hook-shaped projections are each provided with a hook for engagement with the underside of said top wall adjacent said cartridge openings.

18. The improvement according to claim 17 further including:

protuberances positioned adjacent each of the cartridge openings and extending from said under surface; and protuberances on each of said hooks, said hook protuberances being adapted to move over said cartridge opening protuberances for providing a latching engagement of said tool with said top wall.

19. The improvement according to claim 1 further including an annular groove (90) in one of said cartridge exterior and said housing interior, an O-ring (88) positioned in the groove and comprising two pairs of upwardly and downwardly extending annular ridges **(88*a*, 88*b*) and an outwardly extending annular projection (88*c*)** for furnishing enhanced areas of engagement with the annular groove.

20. An odor trap apparatus for conveyance of wastewater to an external drain, including:

a housing (32) having an interior and an opening (48) extending from the interior to the external drain;

a cartridge (22) having an exterior and rotatably receivable in the housing interior, and an opening (26) for receiving the wastewater, and an exit opening (78) disposed to be alignable with the housing opening 9 for providing a wastewater flow path;

a lever (52) for closing said housing opening (48) when said housing opening and said cartridge exit opening (78) are at other than being aligned, for blocking any unpleasant odors from sewer gasses from entering said housing, said lever having a swivelable coupling to said housing, a cap (54) on said lever sized to block said housing opening (48), and a coupling (56, 80) between said cartridge and said lever comprising a projection (56) on said lever and a blind opening (80) in said cartridge for enabling said lever to swivel when said cartridge is rotated with respect to said housing.

21. An odor trap apparatus for conveyance of wastewater to an external drain, including:

a housing (32) having an interior and an opening (48) extending from the interior to the external drain, and a plurality of L-shaped keyways in the interior having vertical and generally horizontal components (62, 64) joined at an intersection;

a cartridge (22) having an exterior and rotatably receivable and sealable in the housing interior, and further having an opening (26) for receiving the wastewater, an exit opening (78) disposed to communicate with the housing opening for providing a wastewater flow path therewith, and keys equal in number to said L-shaped keyways and fittable therein said cartridge exit opening being alignable with said housing opening when said keys are disposed fully within the keyway horizontal components.

22. The improvement according to claim 21 in which said generally horizontal component (64) is inclined downwardly from the intersection for enabling said key to act as a cam to facilitate separation of said cartridge from said housing.

23. An odor trap apparatus for conveyance of wastewater to an external drain, including a housing (32) having an opening (48) extending to the external drain, and a cartridge (22) receivable in the housing and having a top wall provided with a plurality of openings (26) therein for receiving the wastewater, an exit opening (78) disposed to communicate with the housing opening; and a tool having hook-shaped projections for engagement with said openings for enabling insertion into, and removal of said cartridge from said housing.

24. The improvement according to claim 23 in which said hook-shaped projections are each provided with a hook for engagement with the underside of said top wall adjacent said cartridge openings, and protuberances positioned adjacent each of the cartridge openings and extending from said under surface; and protuberances on each of said hooks, said hook protuberances being adapted to move over said cartridge opening protuberances for providing a latching engagement of said tool with said top wall.

* * * * *